US005449870A

United States Patent [19]

Riedel et al.

[11] Patent Number: 5,449,870

[45] Date of Patent: Sep. 12, 1995

[54] SWITCH ACTUATING ASSEMBLY HAVING ATTACHABLE TRIGGER

[75] Inventors: Michael J. Riedel, Northfield; Eli G. Anich, Akron, both of Ohio

[73] Assignee: Lucerne Products, Inc., Hudson, Ohio

[21] Appl. No.: 843,732

[22] Filed: Feb. 28, 1992

[51] Int. Cl.[6] ..... H01H 3/20

[52] U.S. Cl. ..... 200/330; 200/341; 200/345

[58] Field of Search ..... 200/341, 345, 330, 331, 200/338, 332.2, 522

[56] References Cited

U.S. PATENT DOCUMENTS

| | | | |
|---|---|---|---|
| 3,882,294 | 5/1975 | Hults | 200/332.2 X |
| 3,904,844 | 9/1975 | Sahrbacker | 200/522 |
| 4,051,340 | 9/1977 | Walski | 200/329 |
| 4,568,807 | 2/1986 | Piber | 200/522 X |
| 4,791,257 | 12/1988 | Frey et al. | 200/345 X |
| 4,845,325 | 7/1989 | Burchett et al. | 200/345 X |
| 5,120,923 | 6/1992 | Kato et al. | 200/341 X |

*Primary Examiner*—Henry J. Recla
*Assistant Examiner*—David J. Walczak
*Attorney, Agent, or Firm*—Renner, Kenner, Greive, Bobak, Taylor & Weber

[57] ABSTRACT

A switch actuating assembly having an attachable trigger accommodates the implementation of numerous trigger designs and configurations with a single switch assembly. The slide actuator has a head and neck portion which is adapted for locking and mating receipt by a pair of deflectable legs in U-shaped configuration positioned in spaced apart relationship from a pair of flanges. The head of the actuator is engaged in the space between the flanges and the legs, while lips on both the legs and the neck portion provide further interlocking engagement. The positioning of the head within a space between the flange and legs prevents axial movement of the actuator with respect to the trigger assembly, while the interengagement of the lips prevents any vertical movement between the two.

6 Claims, 2 Drawing Sheets

SWITCH ACTUATING ASSEMBLY HAVING ATTACHABLE TRIGGER

TECHNICAL FIELD

The invention herein resides in the art of switch mechanisms of the type typically employed in power hand tools. More particularly, the invention relates to the actuating assembly for such switch mechanisms and, specifically, to a switch actuating assembly in which the actuator and trigger are separately manufactured and attachably interconnected.

BACKGROUND ART

It is well known in the part of power hand tools that switch mechanisms are employed for controlling the state of actuation of the tool. Such switches typically include a switch housing and an actuating mechanism which is slidably received within the switch housing to make and break contacts to turn the tool on and off. Such switch mechanisms are also employed to control the speed of the motor through appropriate speed control circuitry and/or to control the operational direction of the tool as by implementation of a reversing mechanism.

In previously known switches, the actuating member has typically employed a slide mechanism having one end thereof received within a switch housing and having the other end thereof configured in the form of a trigger or the like for engagement by the operator's finger. Numerous types of trigger configurations and contours are known, some accommodating a single finger, others accommodating plural fingers, some being arcuate tin nature, while others are of a more linear design. In the past, the actuator and trigger have often been configured as a unitary elements, typically being formed or molded together. Accordingly, each actuator and switch assembly has associated therewith a particular trigger configuration. Presently, it has become desirable to provide standardized switch assemblies with various types of trigger configurations. In other words, it has become desirable to provide a means for attaching various types of triggers to a single actuator to be employed in a single switch housing, rather than designing each switch, actuator, and trigger as a single package. The savings in manufacturing costs and the flexibility of the switch to accommodate various trigger configurations is self apparent.

DISCLOSURE OF INVENTION

In light of the foregoing, it is a first aspect of the invention to provide a switch actuating assembly having an attachable trigger which may accommodate triggers of various configurations.

Another aspect of the invention is to provide a switch actuating assembly having an attachable trigger in which the trigger may be easily attached, but not readily detached from the actuator.

Still a further aspect of the invention is the provision of a switch actuating assembly having an attachable trigger in which the actuator and trigger become substantially integral upon attachment, and in which relative movement between the trigger and actuator are precluded.

Yet an additional aspect of the invention is the provision of a switch actuating assembly having an attachable trigger in which cost savings in switch manufacture may be enjoyed as a result of the adaptability of various trigger configurations to a single switch mechanism.

A further aspect of the invention is the provision of a switch actuating assembly having an attachable trigger which is durable and reliable in operation, cost effective, and readily conducive to implementation with state of the art elements and techniques.

The foregoing and other aspects of the invention which will become apparent as the detailed description proceeds are achieved by a switch actuating assembly for a hand tool, comprising: an actuator adapted for receipt by a switch; and a trigger assembly adapted for interlocking engagement with said actuator.

Still further aspects of the invention which will become apparent herein are attained by a switch actuator, comprising: an actuator assembly having a first latch portion; and a trigger assembly having a second latch portion, said first and second latch portions lockingly interengaging said actuator and trigger assemblies.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 2:
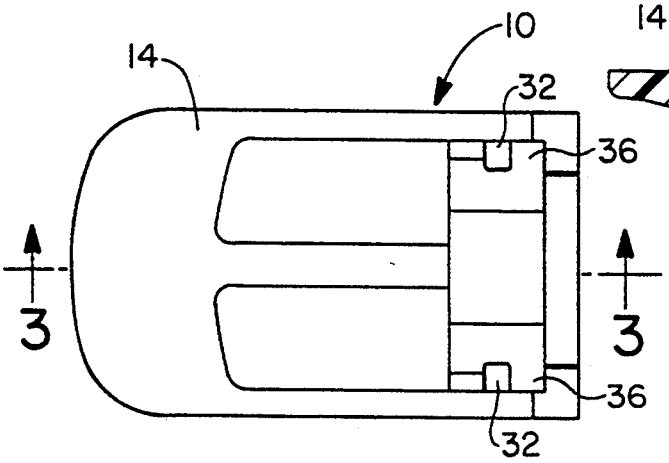
FIG. 2 is a top plan view of the trigger assembly of FIG. 1.
Figure 1:
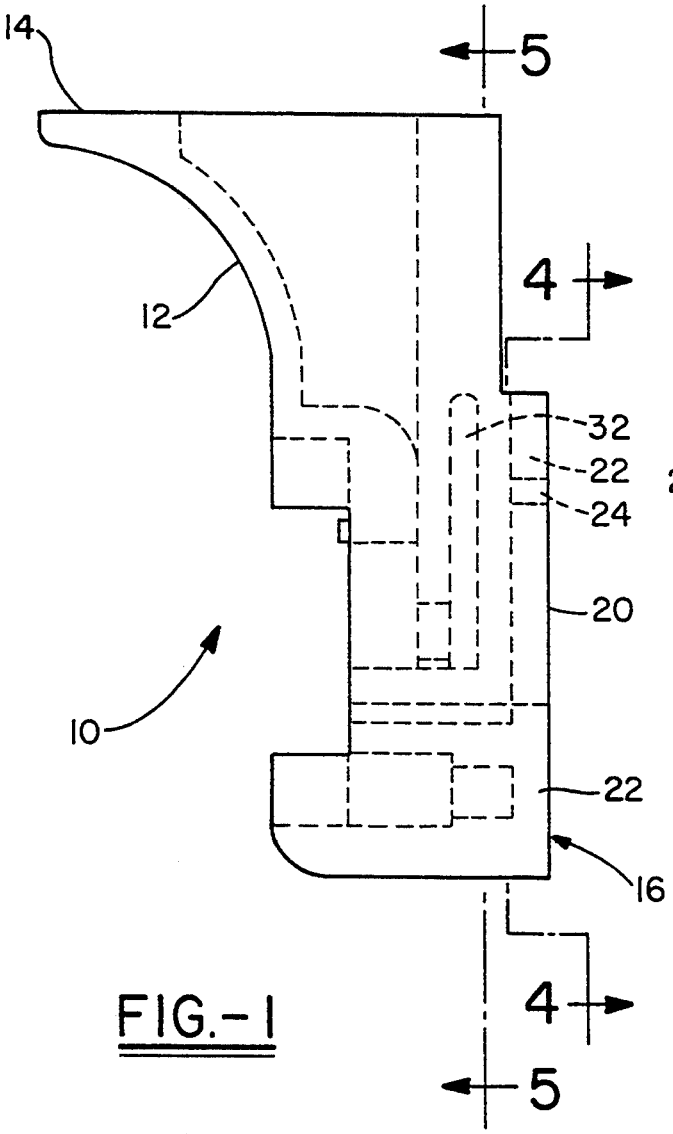
FIG. 1 is a side elevational view of a trigger assembly according to the invention.

Referring now to the drawings and more particularly FIGS. 1 and 2, it can be seen that a trigger assembly according to the invention is designated generally by the numeral 10. It will be appreciated that the trigger assembly 10 comprises a housing molded of plastic or other suitable material as is well known and understood by those skilled in the art. In the embodiment shown, the trigger assembly 10 is provided with an arcuate face 12 providing means for engagement by an operator's finger or the like in standard fashion. It will, of course, be readily understood that the face 12 could be of any of numerous configurations, styles, or contours falling within the scope of the instant invention. Indeed, a portion of the invention is the fact that various trigger configuration may be employed and interconnected with a single actuator for implementation in a single switch construction.

Trigger assembly 10 further includes a top plate 14 which is preferably flat to accommodate the sliding movement of the same within a portion of the associated tool housing. However, the top of the switch assembly 10 may have any of various configurations.

Figure 3:
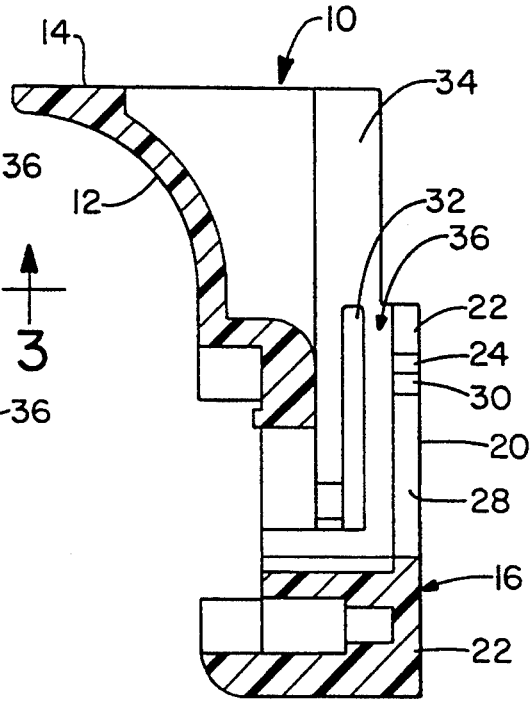
FIG. 3 is a cross sectional view of the trigger assembly of FIGS. 1 and 2 taken along the line 3—3 as shown in FIG. 2.
Figure 4:
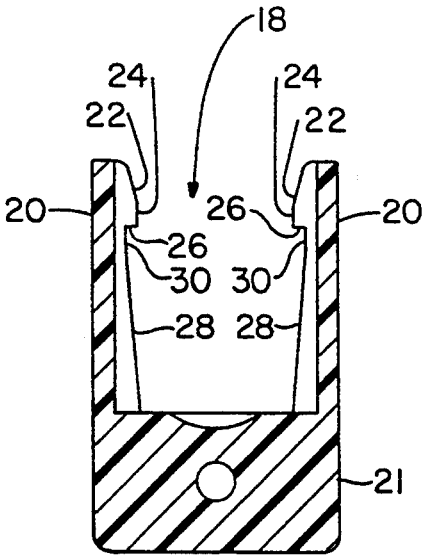
FIG. 4 is a cross sectional view of the trigger assembly of FIG. 1 taken along the line 4—4.

As best shown in FIGS. 3 and 4, a back portion 16 of the trigger assembly 10 is characterized by an opening 18 defined between a pair of parallel upwardly extending legs 20. The legs 20 are commonly connected through a bottom body portion 21 of the trigger assembly 10 such that a U-shaped configuration is obtained between the legs 20 with the opening 18 being open only at the top thereof. Each of the legs 20 is provided with a tapered top surface 22, a short vertical inner surface 24, an undercut defining an overlapping lip 26, and a generally inwardly angled inner surface 28 extending to the bottom body portion 21 as shown. Short vertical surfaces 30, substantially parallel to the surfaces 24, are interposed between the lips 26 and the surfaces 28.

It will be appreciated that the legs 20 are flexible and deflectable as a result of their material of construction and their upwardly extending nature. As will further be appreciated below, the tapered top surfaces 22 assist in the outward deflection of the legs 20 when the actuator is inserted therein to achieve the ultimate desired interengagement between the trigger assembly 10 and the actuator assembly of FIGS. 6 and 7 to be discussed below.

Figure 5:
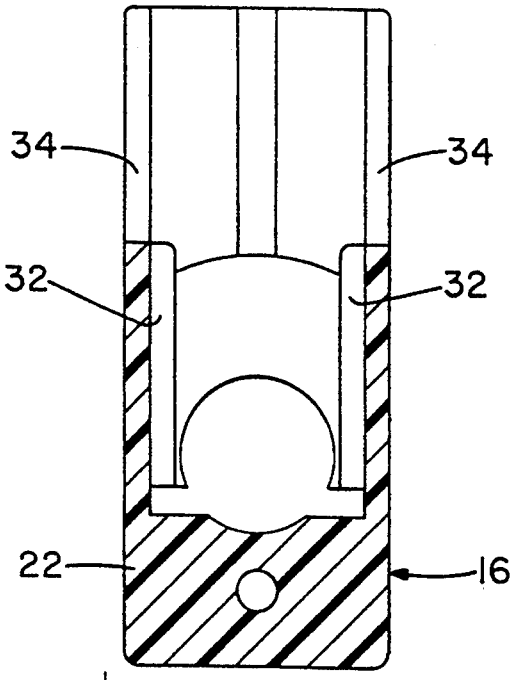
FIG. 5 is a cross sectional view of the trigger assembly of FIG. 1 taken along the line 5—5.

As further shown in FIGS. 1, 3 and 5, a pair of flanges 32 extend inwardly from the sidewalls 34 of the trigger assembly 10 and are maintained substantially parallel to the legs 20 in spaced apart relationship thereto. Indeed, a space 36 is particularly provided between each of the flanges 32 and legs 20 for purposes which will become apparent directly below.

Figure 6:
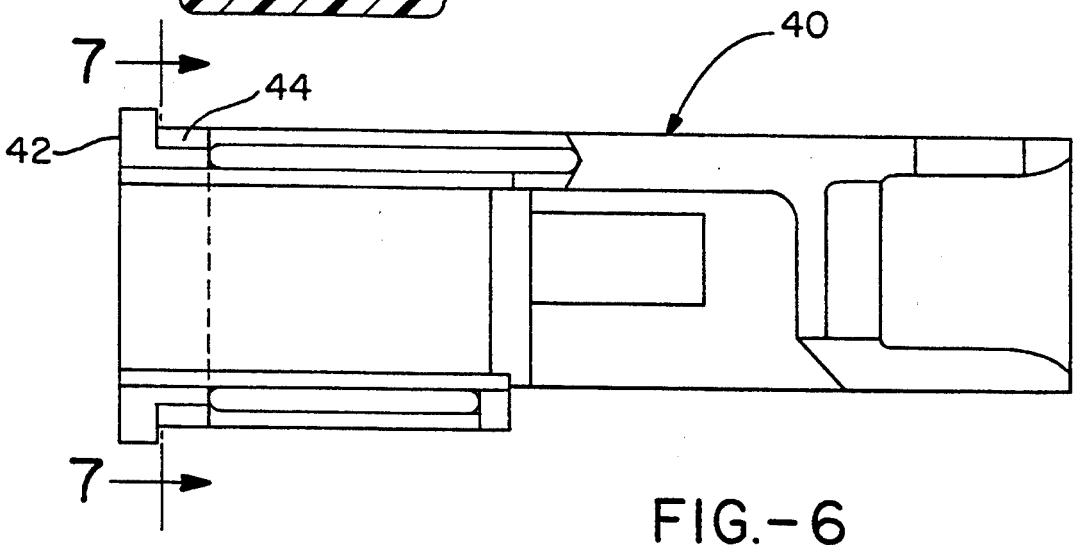
FIG. 6 is a top plan view of the actuator assembly of the invention adapted for mating engagement with the trigger assembly of FIG. 1.

With reference now to FIG. 6, it can be seen that the actuator according to the invention is designated generally by the numeral 40. The actuator assembly 40 is adapted for attachment to the trigger assembly 10 and is provided with body portions configured to be received within a switch housing to electromechanically control the switching mechanism of the associated hand power tool. Those skilled in the art will understand that the actuator 40 is adapted to engage contacts, engage rheostats or variable resistor slides, actuate reversing mechanisms, and/or engage lock-on and/or lock-off features. According to the invention, it is most desirable that the actuator 40 be of a standard configuration adapted for receipt by a standard switch housing and adapted for engagement with various trigger assemblies 10 having trigger face portions 12 of various shapes and configurations.

According to the invention, the actuator 40 is provided with a head 42 at one end thereof. In the embodiment shown, the head 42 is rectangular, although it may be of various configurations. The head 42 has a thickness substantially equal to the width of the space 36 provided between each of the legs 20 and the associated flange 32 in the trigger assembly 10. Additionally, the actuator 40 is provided with a neck portion 44 adjacent to the head 42 and adapted for mating engagement with the legs 20 when received within the opening 18 defined therebetween.

Figure 7:
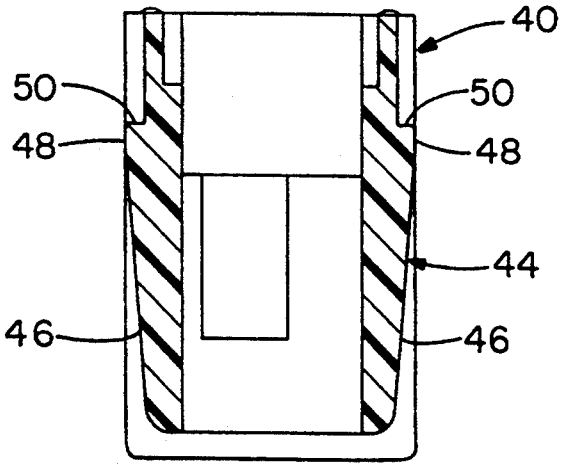
FIG. 7 is a cross sectional view of the actuator assembly of FIG. 6 taken along the line 7—7.

As shown in FIG. 7, the neck portion 44 is characterized by tapered sides 46 provided to engage the tapered top surfaces 22 of the legs 20, spreading the legs apart as the neck portion 44 is urged into the opening 18. Additionally, the tapered sides 46 are configured with the same spacing and angle as the inner surfaces 28 of the legs 20 to be matingly received and nested thereby. In like manner, short vertical surfaces 48 are provided on opposite sides of the neck 44 to be received by and engaged with the vertical surfaces 30 of the legs 20. Finally lips or ledges 50 are provided on the neck portion 44 to lock beneath the undercut lips 26 of the legs 20 when the legs 20 spring or deflect back toward each other after the neck 44 has passed into the opening 18 and been seated upon the bottom thereof. It will be appreciated that the interengagement of the lips 26, 50 prevent any vertical movement of the actuator 40 with respect to the trigger assembly 10. In like manner, receipt of the rectangular head 42 within the space 36 locks the actuator 40 in the horizontal direction, preventing any relative movement horizontally between the actuator 40 and trigger assembly 10. Accordingly, there are provided a trigger assembly and actuator which are interlocked when received within a switch housing and in which the trigger assembly cannot be disengaged from the actuator without direct access to the legs 20 and lips 26, 50. Once the assembled actuator and trigger assembly are received within the switch housing, such access cannot be made and, accordingly, the actuator and trigger assembly appear as an integral unit.

It should now be appreciated by those skilled in the art that the legs 20 and the neck portion 44 serve as respective latch portions for the trigger assembly 10 and the actuator assembly 40. Once engaged, the contour of the neck portion 44 is matingly nested within the corresponding contour defined by the opposed legs 20 so that the trigger and actuator operate and perform in unison as an integral unit.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A switch activating assembly for a hand tool, comprising:

a switch actuator; and a trigger assembly adapted for interlocking engagement with said actuator; and wherein said trigger assembly has a first latch portion and said switch actuator has a second latch portion, said first and second latch portions adapted for locking interengagement, said first latch portion comprising a pair of deflectable legs, each leg having a first lip extending therefrom, said second latch portion having a neck portion with a pair of second lips extending therefrom, each of said pair of second lips adapted for lockingly engaging one of said first lips, said neck portion and said pair of legs being matingly contoured, said neck portion nesting in said pair of legs, said switch actuator having a head at an end thereof adjacent said neck portion, and said first latch portion further comprising retaining means adapted for securing said head and preventing axial movement of said actuator, said retaining means comprising a pair of flanges spaced from said pair of legs, said head being adapted to receipt in a space between said flanges and said legs.

2. The switch actuating assembly according to claim 1, wherein said legs have tapered end portions for engaging tapered side portions of said neck portion to deflect said legs to receive said neck portion.

3. The switch actuating assembly according to claim 2, wherein said legs have inner surfaces contoured to matingly receive outer surfaces of said neck portion.

4. A switch actuator, comprising:

an actuator assembly having a first latch portion; and a trigger assembly having a second latch portion, said first and second latch portions adapted for lockingly interengaging said actuator and trigger assemblies; and wherein said second latch portion comprises a deflectable member, said deflectable member comprising a pair of legs in U-shaped configuration, and said first latch portion comprises a neck received between said pair of legs, said neck and said pair of legs having respective lips adapted for interlocking engagement for preventing relative movement between said actuator and trigger assemblies in a first direction, and wherein said actuator has a head at one end thereof, and said second latch portion further comprises a pair of flanges spaced from said pair of legs, said head being adapted for receipt within said space, said flanges and legs being adapted for preventing relative movement between said actuator and trigger assemblies in a second direction orthogonal to said first direction.

5. The switch actuator according to claim 4, wherein said legs and neck are similarly contoured to nestingly engage.

6. The switch actuating assembly according to claim 5, wherein said legs and neck have tapered surfaces to facilitate deflection of said legs to achieve a desired mating engagement.

* * * * *